US008978746B2

(12) United States Patent
Cornell et al.

(10) Patent No.: US 8,978,746 B2
(45) Date of Patent: Mar. 17, 2015

(54) HEAT EXCHANGER HEADER PLATE

(75) Inventors: Ken Cornell, Oak Creek, WI (US); Eric Boticki, Racine, WI (US); Brian Merklein, Hartford, WI (US)

(73) Assignee: Modine Manufacturing Company, Racine, WI (US)

( * ) Notice: Subject to any disclaimer, the term of this patent is extended or adjusted under 35 U.S.C. 154(b) by 407 days.

(21) Appl. No.: 13/367,211

(22) Filed: Feb. 6, 2012

(65) Prior Publication Data

US 2012/0199332 A1 Aug. 9, 2012

Related U.S. Application Data

(60) Provisional application No. 61/439,642, filed on Feb. 4, 2011.

(51) Int. Cl.

| | |
|---|---|
| ***F28F 9/02*** | (2006.01) |
| *F28D 1/053* | (2006.01) |
| *F28D 21/00* | (2006.01) |

(52) U.S. Cl.

CPC ..... *F28F 9/0224* (2013.01); *F28D 1/05366* (2013.01); *F28D 1/05383* (2013.01); *F28D 2021/0082* (2013.01); *F28F 2009/029* (2013.01)

USPC ..... 165/173; 165/175

(58) Field of Classification Search

CPC ..... F28F 9/04; F28F 9/06; F28F 9/08; F28F 9/14; F28F 9/16; F28F 9/162; F28F 9/18; F28F 9/182

USPC ..... 165/173, 175

See application file for complete search history.

(56) References Cited

U.S. PATENT DOCUMENTS

| | | | | |
|---|---|---|---|---|
| 5,492,172 | A | 2/1996 | Laveran et al. | |
| 7,413,006 | B2 | 8/2008 | DeGroot et al. | |
| 7,461,689 | B2 * | 12/2008 | Merklein et al. | 165/134.1 |
| 7,600,560 | B2 * | 10/2009 | Heuss et al. | 165/173 |
| 2005/0051315 | A1 * | 3/2005 | Ozaki et al. | 165/173 |
| 2006/0213651 | A1 * | 9/2006 | Higashiyama et al. | 165/174 |
| 2007/0000657 | A1 * | 1/2007 | Emrich et al. | 165/173 |
| 2008/0000626 | A1 * | 1/2008 | Sugito et al. | 165/173 |
| 2009/0255657 | A1 * | 10/2009 | Hakamata et al. | 165/178 |
| 2010/0206534 | A1 * | 8/2010 | Amaya et al. | 165/173 |

* cited by examiner

*Primary Examiner* — Mohammad M Ali
*Assistant Examiner* — Raheena Rehman
(74) *Attorney, Agent, or Firm* — Michael Best & Friedrich LLP

(57) ABSTRACT

A header plate for a heat exchanger includes a first side flange, a second side flange spaced apart from and opposing the first flange, and a generally planar surface located between and connecting the first and second flanges. The generally planar surface and the first and second side flanges together at least partially define an internal volume of the heat exchanger. The header plate also includes a bead formed into the generally planar surface to locally deform the surface in a direction away from the internal volume, the bead extending to and blending into the first side flange. The header plate also includes a tube receiving opening extending through the generally planar surface into the internal volume, the tube receiving opening extending through the bead.

20 Claims, 7 Drawing Sheets

HEAT EXCHANGER HEADER PLATE

CROSS REFERENCE TO RELATED APPLICATION

This application claims priority to co-pending U.S. Provisional Patent Application Ser. No. 61/439,642, which was filed on Feb. 4, 2011, the entire contents of which are incorporated herein by reference.

FIELD OF THE INVENTION

The present invention relates to heat exchangers and, more particularly, to header plates for use with heat exchangers.

BACKGROUND

Some heat exchangers include flattened tubes that extend between and are supported by two spaced apart header plates. Each header plate typically includes openings that are shaped and sized to receive ends of the flattened tubes. A fluid tank is fitted and sealed to each header plate to receive heat exchange fluid that flows through the flattened tubes. Such heat exchangers commonly experience thermal cycle stress due to fluids of different temperatures passing through the flattened tubes. In particular, different temperature fluids may cause expansion and/or contraction of the flattened tubes, creating stresses at joints between the tubes and the header plates. As a result, the joints, or the flattened tubes themselves, may fracture, resulting in leakage and possible failure of the heat exchanger.

SUMMARY

In some embodiments, the invention provides a header plate for a heat exchanger, the header plate comprising a first side flange; a second side flange spaced apart from and opposing the first flange; a generally planar surface located between and connecting the first and second flanges, the generally planar surface and the first and second side flanges together at least partially defining an internal volume of the heat exchanger; a bead formed into the generally planar surface to locally deform the surface in a direction away from the internal volume, the bead extending to and blending into the first side flange; and a tube receiving opening extending through the generally planar surface into the internal volume, the tube receiving opening extending through the bead.

In other embodiments, the invention provides a heat exchanger comprising a plurality of parallel arranged flat tubes having internal passages to convey a fluid through the heat exchanger; a fluid tank; and a header plate coupled to the fluid tank to at least partially define an internal volume of the heat exchanger, the header plate comprising a first flange, a second flange spaced apart from and opposing the first flange, a generally planar surface located between and connecting the first and second flanges, a bead formed into the generally planar surface to locally deform the surface in a direction away from the internal volume, the bead extending to and blending into the first side flange, and a plurality of tube receiving openings extending through the generally planar surface into the internal volume and receiving an end of one of the plurality of parallel arranged flat tubes, wherein at least one of the plurality of tube receiving openings extends through the bead.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
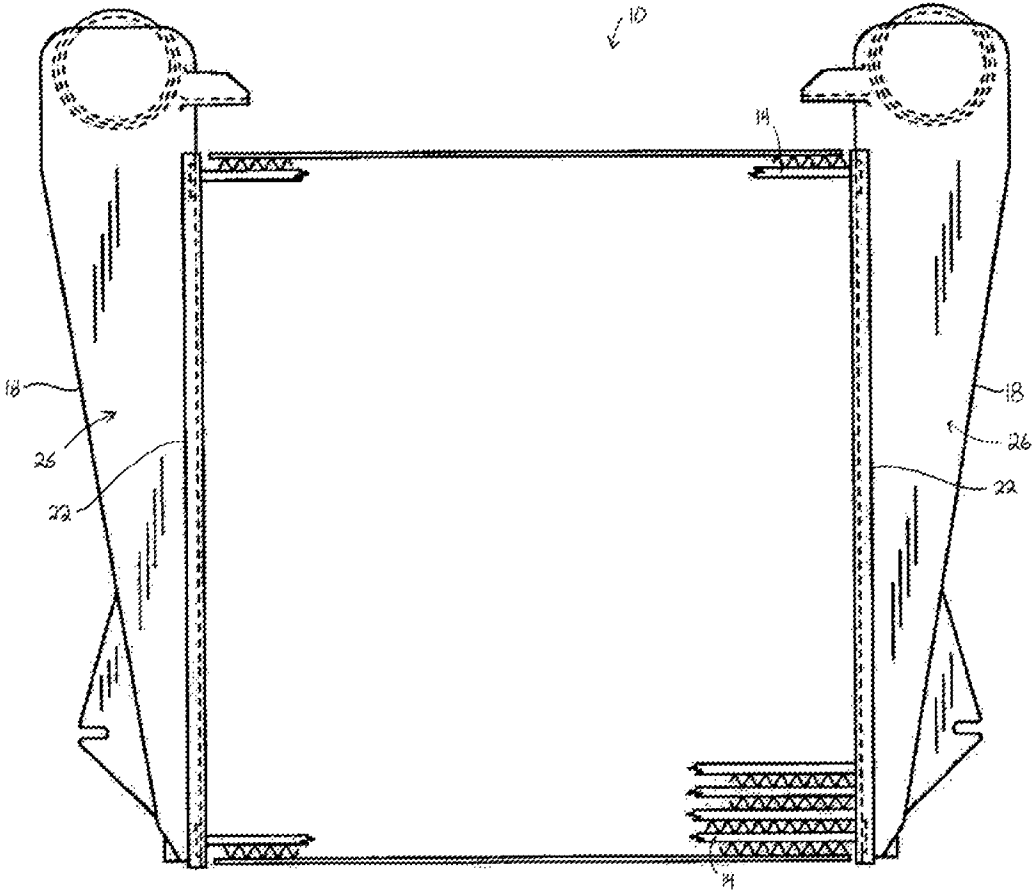
FIG. 1 schematically illustrates a heat exchanger according to one embodiment of the invention.

FIG. 1 illustrates a heat exchanger 10, which may be, for example, a charge-air-cooler or intercooler positioned downstream of a turbocharger in a vehicle engine. The heat exchanger 10 includes a plurality of flat tubes 14 arranged in parallel, a fluid tank 18 positioned at each end of the heat exchanger 10, and a header plate 22 coupled to each fluid tank 18. The tubes 14 are generally elongated tubes defined by two rounded ends and two generally flattened sides that connect the ends. Each tube 14 extends between the header plates 22 and has an internal passage to convey a fluid through the heat exchanger 10. The fluid tanks 18 and the header plates 22 at least partially define internal volumes 26 of the heat exchanger 10. The internal volumes 26 confine fluid within the heat exchanger 10 as the fluid passes through the tubes 14 and fluid tanks 18.

Figure 2:
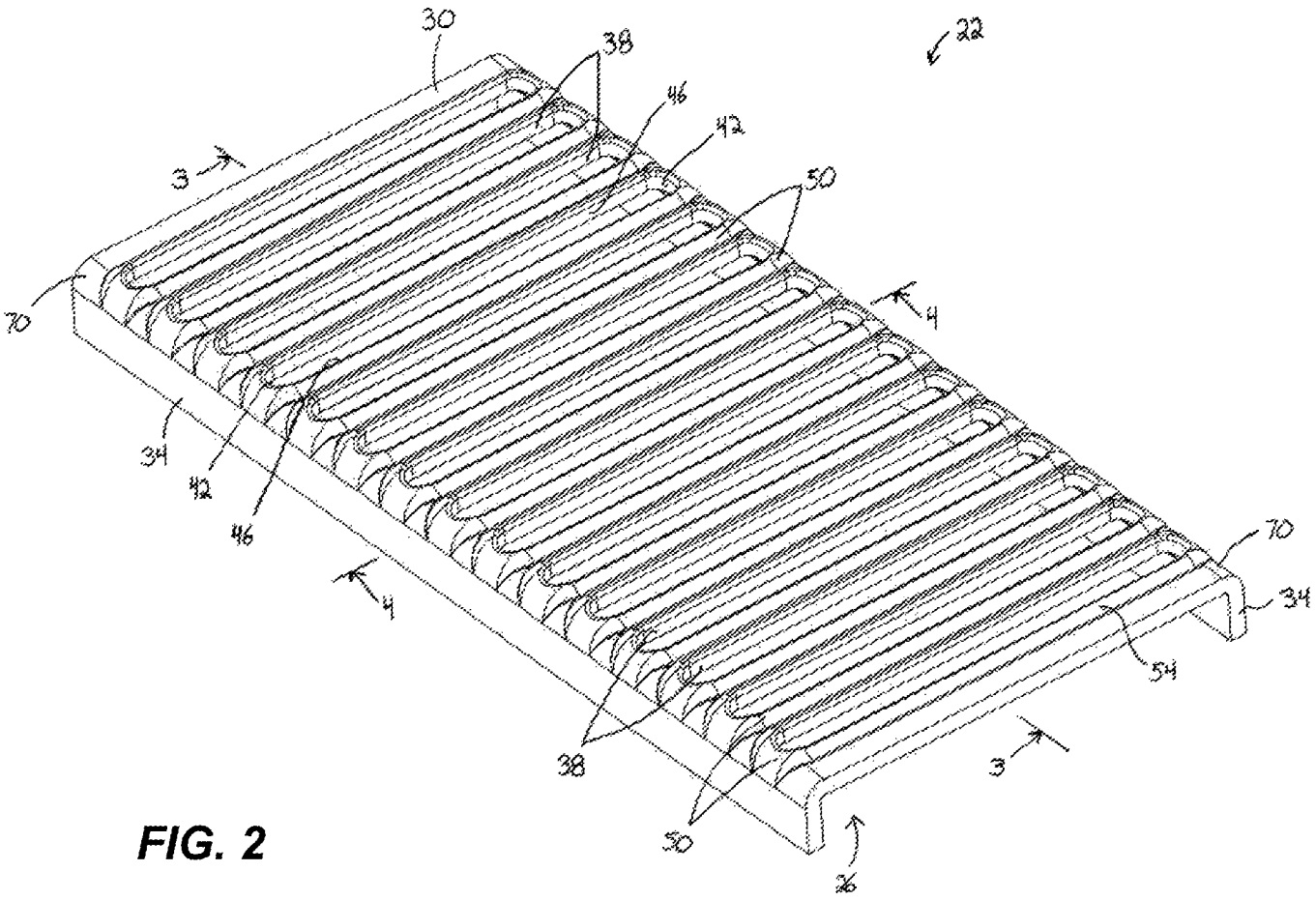
FIG. 2 is a perspective view of a header plate of the heat exchanger of FIG. 1.
Figure 3:
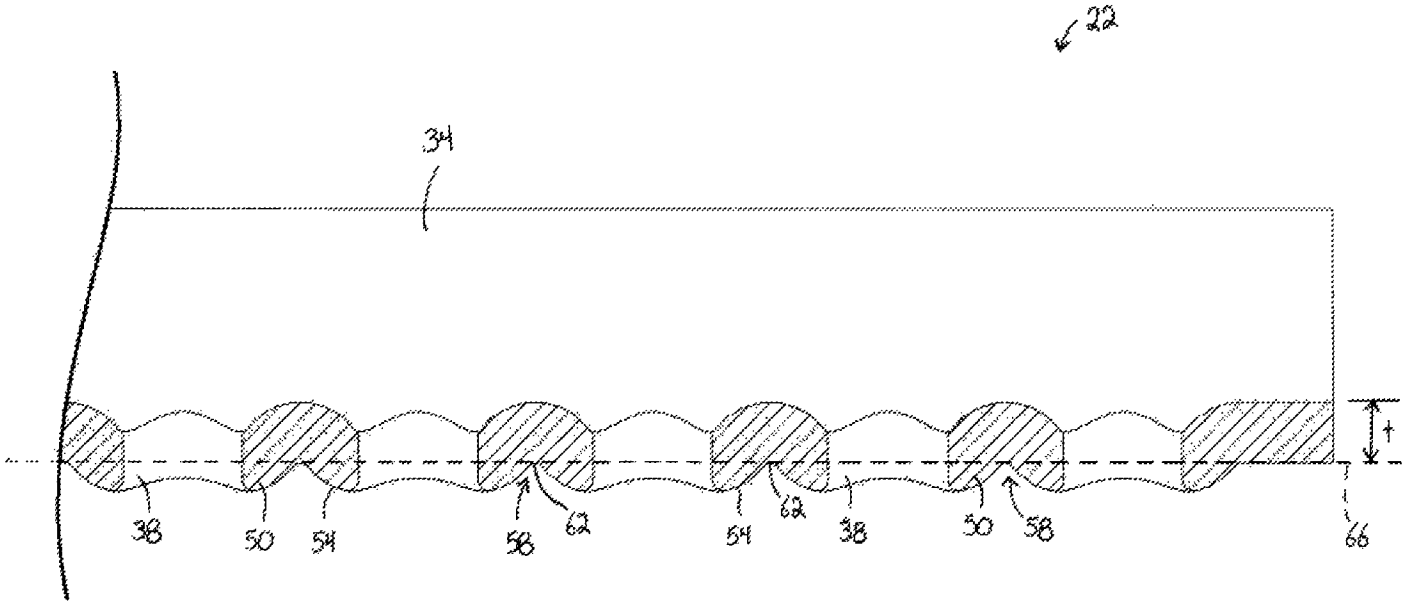
FIG. 3 is a cross-sectional view of a portion of the header plate taken along section line 3-3 of FIG. 2.
Figure 4:
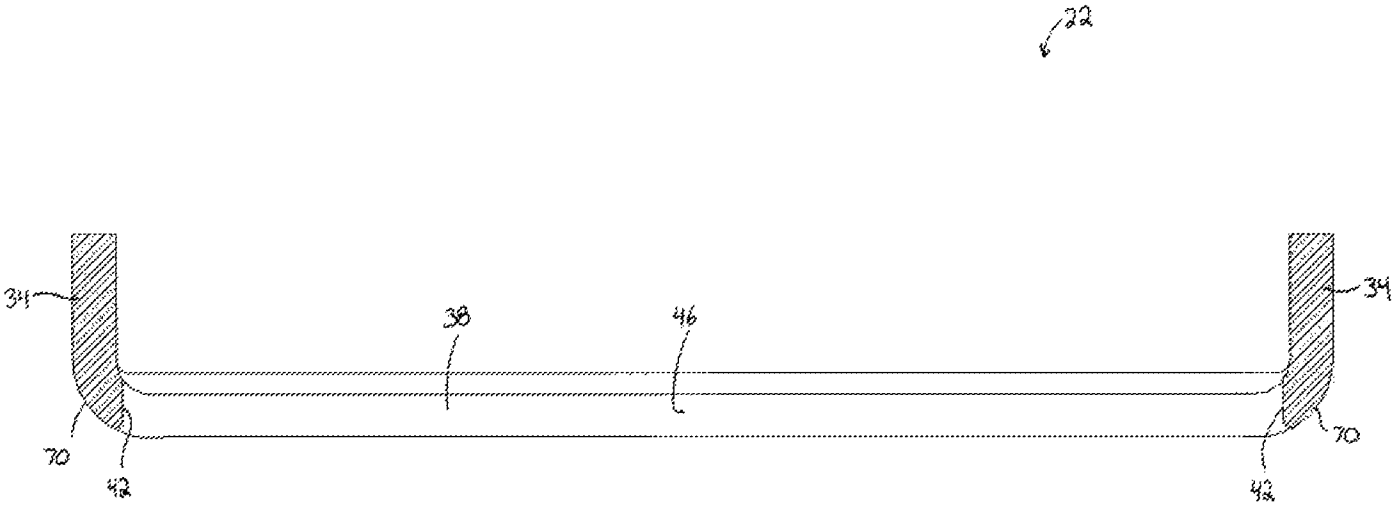
FIG. 4 is a cross-sectional view of the header plate taken along section line 4-4 of FIG. 2.

FIGS. 2-4 illustrate one of the header plates 22 in detail. Although only one header plate 22 is shown, it should be readily apparent that the other header plate 22 in the heat exchanger 10 can be substantially similar to the illustrated header plate 22. In the illustrated embodiment, the header plate 22 includes a generally planar surface 30, a pair of side flanges 34, and a plurality of tube receiving openings 38. The planar surface 30 extends between and connects the flanges 34. The flanges 34 are spaced apart from each other on opposing sides of the planar surface 30 and extend generally perpendicularly from the planar surface 30. The flanges 34 couple to and engage the corresponding fluid tank 18 (FIG. 1) to help define the internal volume 26 of the heat exchanger 10.

The tube receiving openings 38 are formed in and extend through the generally planar surface 30 to the internal volume 26. In the illustrated embodiment, the header plate 22 includes fifteen tube openings 38 arranged in a single row. In other embodiments, the header plate 22 can include fewer or more tube openings 38. Additionally or alternatively, the tube openings 38 can be arranged in multiple rows, can be spaced apart by different distances, and/or can be arranged in different orientations. Each opening 38 receives an end of one of the tubes 14 of the heat exchanger 10 to support the tube 14. As shown in FIG. 2, the illustrated openings 38 include two rounded ends 42 and two elongated straight sides 46 that generally match the shape and size of the tubes 14 and create a relatively tight fit between the header plate 22 and the tubes 14. After having been received into the openings 38, the tubes 14 can be permanently and sealingly affixed to the header plate 22 by brazing, soldering, welding, mechanical expansion, or other joining processes known in the art.

The header plate 22 also includes a plurality of beads 50 formed into the generally planar surface 30. The beads 50 locally deform the surface 30 in a direction away from the internal volume 26 such that the beads 50 stand above the planar surface 30. In the illustrated embodiment, the beads 50 are drawn out from the planar surface 30 in a direction substantially opposite the direction that the flanges 34 extend from the planar surface 30.

In the illustrated embodiment, a single continuous bead 50 is located adjacent each tube opening 38 and substantially wraps around (e.g., surrounds) the opening 38 such that each tube receiving opening 38 extends through one of the beads 50. When the tubes 14 (FIG. 1) are inserted into the openings 38, the beads 50 surround end portions of the tubes 14 to couple the tubes 14 to the header plate 22. In other embodiments, multiple continuous or discontinuous beads may be formed into the planar surface 30 adjacent each tube opening 38 such that each tube opening 38 extends through more than one bead.

As shown in FIG. 3, each bead 50 has a generally rounded outer surface 54 whose apex defines the edge or perimeter of the corresponding tube opening 38. A V-shaped groove 58, or channel, is defined between the rounded outer surfaces 54 of adjacent beads 50. Troughs 62 of the grooves 58 define a plane 66 that approximately represents the shape of the planar surface 30 if the beads 50 were not present. The beads 50 are formed in the planar surface 30 to extend beyond the plane 66 by a fraction of the thickness of the header plate 22, without increasing the amount of material on the plate 22. For example, in the illustrated embodiment, the header plate 22 has a thickness t of approximately 4 mm and the beads 50 extend beyond the plane 66 approximately 2 mm, or about half of the thickness of the header plate 22. However, the thickness of material at the beads 50 is not greater than the thickness t of the header plate 22 because the beads 50 are formed by drawing or bending a portion of the planar surface 30 into the desired bead shape, rather than by adding material to the plate 22. In other embodiments, the beads 50 may be formed in the planar surface 30 to extend beyond the plane 66 by a greater or lesser amount. By way of example, in some embodiments, the beads 50 can extend beyond the plane 66 by an amount ranging from 25% to 75% of the thickness t of the header plate 22.

In the illustrated embodiment, the troughs 62 of the grooves 58 are spaced apart approximately 16 mm such that each bead 50 is approximately 16 mm wide. As such, the ratio of bead width to bead height (i.e., the height of the bead 50 extending beyond the plane 66) is approximately 8. In other embodiments, the ratio of bead width to bead height may be larger or smaller.

Referring to FIGS. 2 and 4, each tube opening 38 passes through a portion of a generally arcuate surface 70 on each side of the header plate 22. The arcuate surfaces 70 define the transition from the generally planar surface 30 to the side flanges 34. In the illustrated embodiment, the beads 50 extend across the entire planar surface 30 to the flanges 34. As such, the beads 50 extend at least partially over the arcuate surfaces 70 to extend past rounded ends 42 of openings 38 to wrap entirely around the rounded ends 42 of the tube openings 38. In the illustrated embodiment, the beads 50 decrease in height along the arcuate surfaces 70 thereby blending into the side flanges 34, forming a smooth transition from the flanges 34 to the beads 50.

As seen in FIG. 4, by extending the beads 50 entirely across the surface 30 to the flanges 34, the openings 38 are kept entirely within the beads 50 while at the same time providing only a minimal clearance between the inner surfaces of the flanges 34 and the rounded ends of the tubes 14 (generally corresponding to the rounded ends 42 of the openings 38). Minimizing such clearances provides benefits in the ability of the heat exchanger 10 to withstand structural loadings such as can be caused by pressure cycling of the fluid in the internal volumes 26.

According to one method of manufacturing the header plate 22, a flat sheet is first machined, molded, formed, or otherwise provided. The beads 50 are then formed in the generally planar surface 30 of the flat sheet by drawing portions of the sheet outward. After the beads 50 are formed, holes are pierced or cut through the beads 50 to form the tube receiving openings 38. Piercing the holes after the beads 50 are drawn makes it easier to create tube receiving openings of the desired shape and size. Otherwise, the tube receiving openings 38 may deform or warp if the beads are drawn around the holes after the holes are pierced. Edges of the flat sheet are subsequently bent to form the side flanges 34. In some embodiments, it may be preferable to form the side flanges 34 at an earlier stage of the manufacturing process. For example, the side flanges 34 may be formed concomitant with the forming of the beads 50, or after forming the beads 50 but before creating the openings 38.

Figure 5:
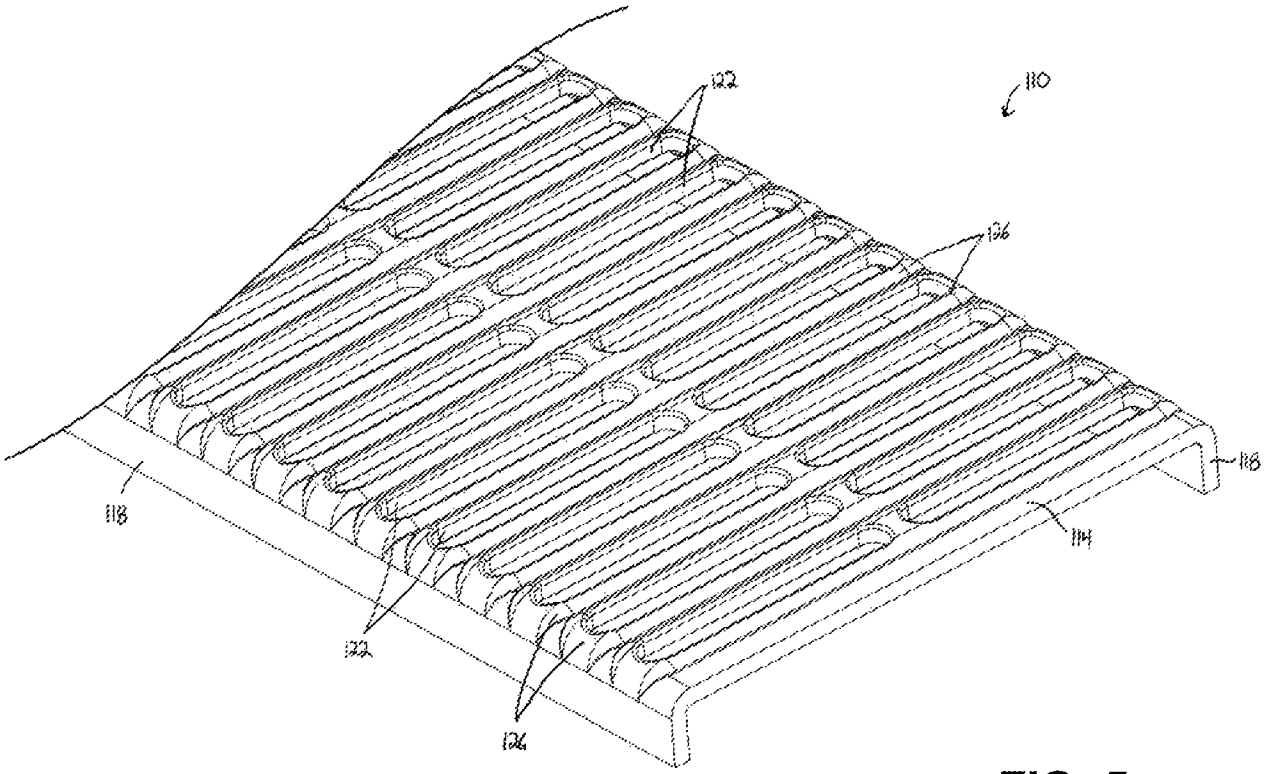
FIG. 5 is a perspective view of a portion of a header plate according to another embodiment of the invention.

FIG. 5 illustrates a header plate 110 according to another embodiment of the invention. Similar to the header plate 22 discussed above with reference to FIG. 2, the illustrated header plate 110 includes a generally planar surface 114, two side flanges 118 extending perpendicularly from the planar surface 114, and a plurality of tube receiving openings 122 extending through the planar surface 114. In the illustrated embodiment, the tube openings 122 are arranged in two parallel rows, rather than a single row, such that the header plate 110 can support two rows of tubes. In other embodiments, the header plate 110 may include three or more rows of tube openings 122.

The illustrated header plate 110 also includes a plurality of beads 126 formed into the planar surface 114. Similar to the beads 50 discussed above, the beads 126 may be formed into the planar surface 114 by drawing a portion of the planar surface 114 outward without increasing the amount of material on the header plate 110. In the illustrated embodiment, the beads 126 are drawn out of the planar surface 114 at a relatively constant height across the entire planar surface 114. In other embodiments, the beads 126 may be drawn out of the planar surface 114 at irregular heights.

As shown in FIG. 5, adjacent tube openings 122 from each row extend through a single bead 126 such that one continuous bead 126 wraps around both openings 122. In other embodiments, each bead 126 may only wrap around a single tube opening 122. In such embodiments, the header plate 110 may include two rows of discontinuous beads corresponding to the two parallel rows of tube openings. The illustrated beads 126 extend across the planar surface 114 and blend into both of the side flanges 118. In some embodiments, each bead 126 may blend into only one of the flanges 118.

Figure 6:
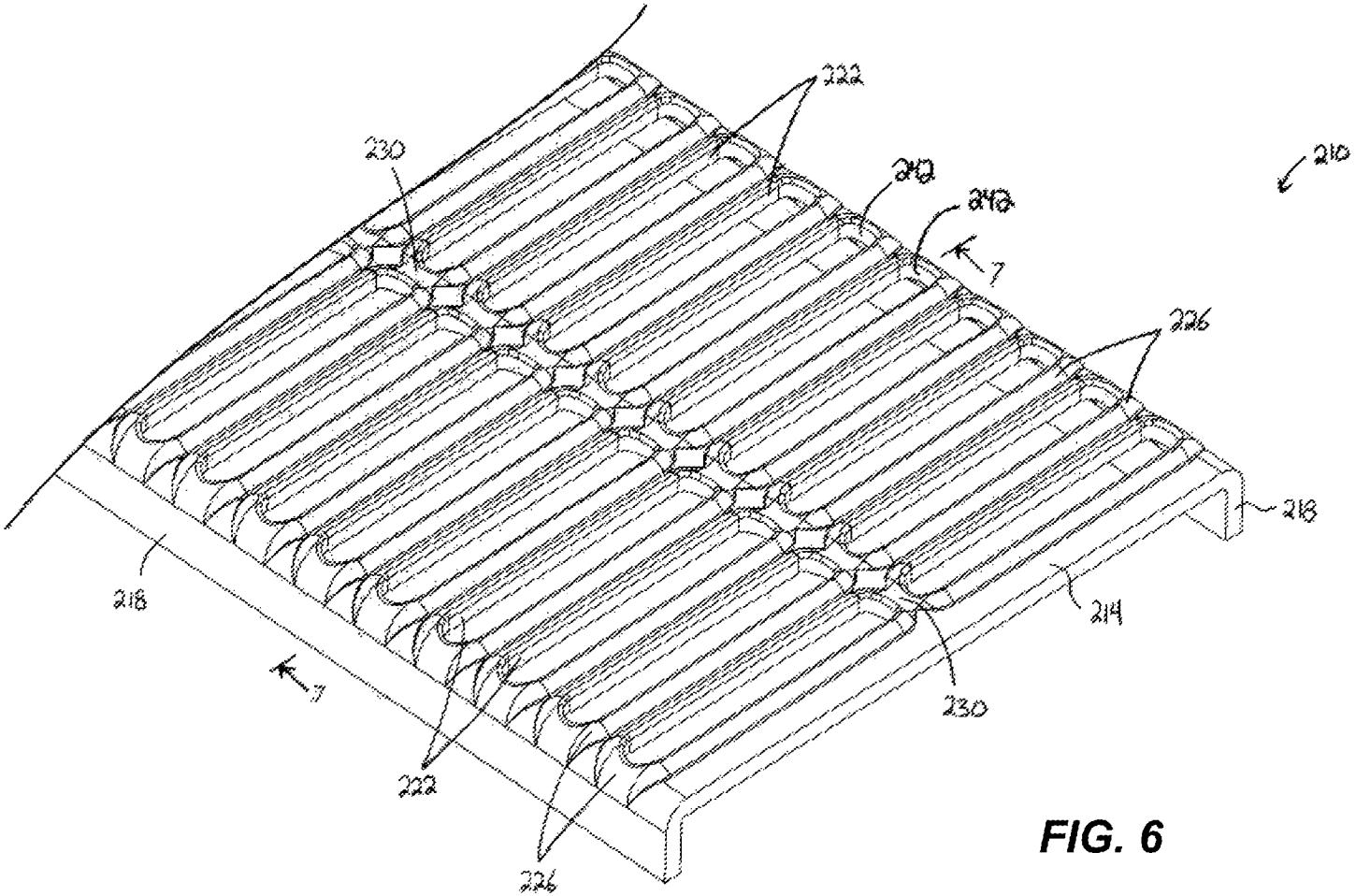
FIG. 6 is a perspective view of a portion of a header plate according to yet another embodiment of the invention.
Figure 7:
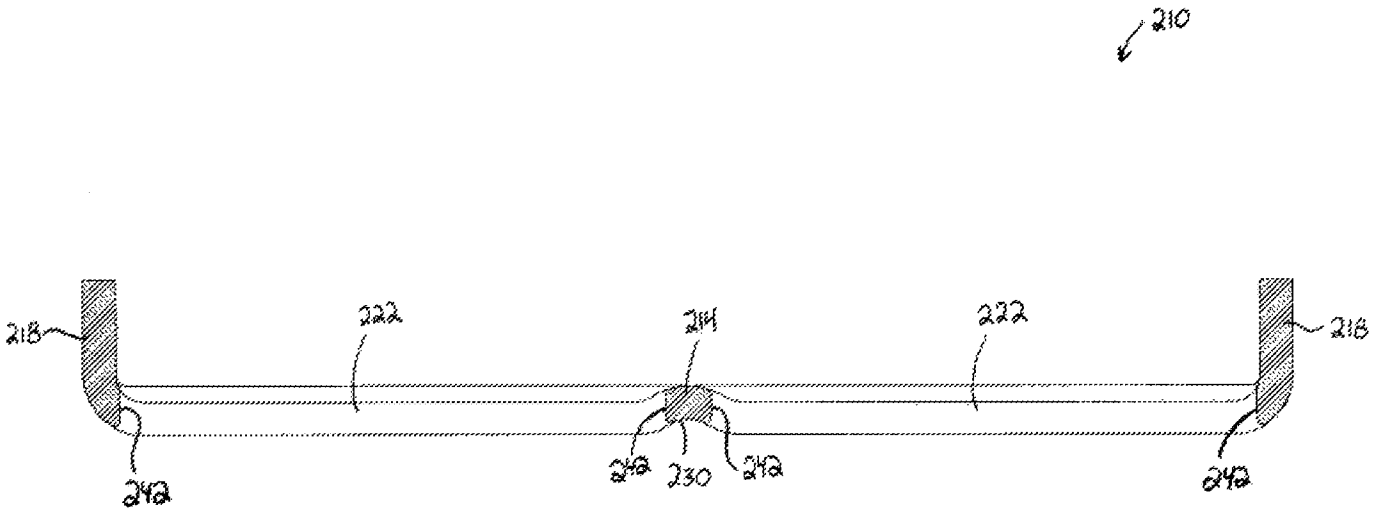
FIG. 7 is a cross-sectional view of the header plate taken along section line 7-7 of FIG. 6.

FIGS. 6 and 7 illustrate a header plate 210 according to yet another embodiment of the invention. The header plate 210 includes a generally planar surface 214, two side flanges 218 extending perpendicularly from the planar surface 214, and a plurality of tube receiving openings 222 extending through the planar surface 214. Similar to the header plate 110 discussed above with reference to FIG. 5, the tube openings 222 of the illustrated header plate 210 are arranged in two parallel rows, rather than a single row.

The illustrated header plate 210 also includes a plurality of beads 226 formed into the planar surface 214. Similar to the beads 50, 126 discussed above, the beads 226 may be formed into the planar surface 214 by drawing a portion of the planar surface 214 outward without increasing the amount of material on the header plate 210. In the illustrated embodiment, the beads 226 are arranged in parallel rows in direct correspondence to the parallel rows of tube openings 222, so that each of the beads 226 wraps around a single tube opening 222.

Each pair of side-by-side arranged beads 226 includes a mid portion 230 positioned therebetween. As shown in FIG. 6, the mid portion 230 between each pair of beads 226 is tapered or pinched such that the beads 226 more closely follow the contours of rounded ends 242 of the tube openings 222. In addition, as shown in FIG. 7, the mid portion 230 between the beads 226 is slightly recessed such that the mid portion 230 does not extend as far outward from the planar surface 214 as the remainder of the beads 226. Accordingly, the three-dimensional profile of the rounded ends 242 of the tube openings 222 located toward the center of the header plate 210 is similar to the profile of the rounded ends 242 near the flanges 218. Such an arrangement also reduces the amount of material that needs to be drawn out from the planar surface 214 to form the beads 226.

Forming beads on header plates reduces thermal stresses at joints between the header plates and the tubes of a heat exchanger. The beads allow the header plate and the tubes to be used in relatively higher-temperature applications, such as at inlet temperatures greater than 275 Celsius. In some scenarios, the beads provide a 20 percent reduction in stress, which may increase the thermal cycle life of the header plate up to four times that of a standard pierced header plate.

The beads also provide a low cost solution to increase the strength, life, and durability of header plates since they do not require additional material or components to manufacture.

Various features and advantages of the invention are set forth in the following claims.

The invention claimed is:

1. A header plate for a heat exchanger, the header plate comprising:
- a first side flange;
- a second side flange spaced apart from and opposing the first flange;
- a generally planar surface located between and connecting the first and second flanges, the generally planar surface and the first and second side flanges together at least partially defining an internal volume of the heat exchanger;
- a bead formed into the generally planar surface to locally deform the surface in a direction away from the internal volume, the bead extending to and blending into the first side flange; and
- a tube receiving opening extending through the generally planar surface into the internal volume, the tube receiving opening extending through the bead,
- wherein the tube receiving opening is a first tube receiving opening, the header plate further comprising a second tube receiving opening, wherein the first and the second tube receiving openings extend through the bead.

2. The header plate of claim 1, wherein the bead is a first bead, the header plate further comprising a second bead, and wherein the second bead extends to and blends into the second side flange.

3. The header plate of claim 1, wherein the bead extends to and blends into the second side flange.

4. The header plate of claim 1, further comprising a generally arcuate surface that defines a transition from the generally planar surface to one of the first side flange and the second flange, and wherein the tube receiving opening passes through the generally arcuate surface of the header plate.

5. A heat exchanger comprising:
- a plurality of parallel arranged flat tubes having internal passages to convey a fluid through the heat exchanger;
- a fluid tank; and
- a header plate coupled to the fluid tank to at least partially define an internal volume of the heat exchanger, the header plate comprising:
  - a first flange,
  - a second flange spaced apart from and opposing the first flange,
  - a generally planar surface located between and connecting the first and second flanges,
  - a bead formed into the generally planar surface to locally deform the surface in a direction away from the internal volume, the bead extending to and blending into the first side flange such that the bead and the flange form a continuous arc, and
  - a plurality of tube receiving openings extending through the generally planar surface into the internal volume and receiving an end of one of the plurality of parallel arranged flat tubes, wherein at least one of the plurality of tube receiving openings extends through the bead,
  - wherein the bead extends to and blends into the second side flange.

6. The heat exchanger of claim 5, wherein at least two tube receiving openings of the plurality of tube receiving openings extend through the bead.

7. The heat exchanger of claim 5, wherein the bead is a first bead, wherein the header plate further comprises a second bead, and wherein the second bead extends to and blends into the second side flange.

8. The heat exchanger of claim 5, wherein the header plate includes arcuate surfaces on each side of the header plate that define transitions from the generally planar surface to the side flanges.

9. The heat exchanger of claim 5 wherein the fluid tank and the header plate are a first fluid tank and a first header plate and the internal volume is a first internal volume, the heat exchanger further comprising:
- a second fluid tank; and
- a second header plate coupled to the second fluid tank to at least partially define a second internal volume of the heat exchanger, the second header plate having a plurality of tube receiving openings extending into the second internal volume and receiving another end of the plurality of parallel arranged flat tubes, the internal passages of the parallel arranged flat tubes providing fluid communication between the first and second internal volumes.

10. The heat exchanger of claim 9, wherein the second header plate includes:
- a first flange;
- a second flange spaced apart from and opposing the first flange;
- a generally planar surface located between and connecting the first and second flanges; and
- a bead formed into the generally planar surface to locally deform the surface in a direction away from the second internal volume, the bead extending to and blending into the first side flange, wherein at least one of the plurality of tube receiving openings extends through the bead.

11. The header plate of claim 1, wherein the header plate has a general thickness and wherein the bead has a height from the generally planar surface to an apex of the bead that is not greater than the thickness.

12. The header plate of claim 1, wherein the bead extends from the first side flange to the opening in a continuous arc.

13. The header plate of claim 1, wherein the tube receiving opening further includes two rounded ends.

14. The header plate of claim 1, wherein the second opening is located laterally of the first opening relative to the heat exchanger.

15. The header plate of claim 1, wherein the header plate has a general plate thickness and the bead has a general bead thickness and wherein the bead thickness does not exceed the plate thickness.

16. The header plate of claim 1, further including a groove adjacent to the bead extending transversely to the header plate, wherein the groove is located in the same plane as the planar surface.

17. The heat exchanger of claim 5, wherein the header plate has a general thickness and wherein the bead has a height from the generally planar surface to an apex of the bead that is not greater than the thickness.

18. The heat exchanger of claim 5, wherein the header plate has a general plate thickness and the bead has a general bead thickness and wherein the bead thickness does not exceed the plate thickness.

19. A header plate for a heat exchanger, the header plate comprising:

a first side flange;

a second side flange spaced apart from and opposing the first flange;

a generally planar surface located between and connecting the first and second flanges, the generally planar surface and the first and second side flanges together at least partially defining an internal volume of the heat exchanger;

a bead formed into the generally planar surface to locally deform the surface in a direction away from the internal volume, the bead extending to and blending into the first side flange;

a tube receiving opening extending through the generally planar surface into the internal volume, the tube receiving opening extending through the bead; and a generally arcuate surface that defines a transition from the generally planar surface to one of the first side flange and the second flange, and wherein the tube receiving opening passes through the generally arcuate surface of the header plate.

20. The header plate of claim 19, wherein the bead extends to and blends into the second side flange.

* * * * *